US005281184A

United States Patent [19]

Suimon

[11] Patent Number: 5,281,184

[45] Date of Patent: Jan. 25, 1994

[54] STEERING DEVICE FOR AUTOMOTIVE VEHICLE TOY

[75] Inventor: Yoshio Suimon, Tokyo, Japan

[73] Assignee: Kabushiki Kaisha Hanzawa Corporation, Tokyo, Japan

[21] Appl. No.: 920,828

[22] Filed: Jul. 28, 1992

[30] Foreign Application Priority Data

Apr. 8, 1992 [JP] Japan ..... 4-021654[U]

[51] Int. Cl.[5] ..... A63H 17/385

[52] U.S. Cl. ..... 446/460; 446/468

[58] Field of Search ..... 446/443, 454, 455, 456, 446/444, 460, 462, 463, 468; 192/105 BA

[56] References Cited

U.S. PATENT DOCUMENTS

| | | | |
|---|---|---|---|
| Re. 19,110 | 3/1934 | Bethenod et al. | 192/105 BA |
| 2,564,826 | 8/1951 | Yoder | 192/105 BA |
| 4,545,451 | 8/1985 | Pipa et al. | 446/463 X |
| 4,563,162 | 1/1986 | Ishimoto | 446/460 X |

FOREIGN PATENT DOCUMENTS

| | | | |
|---|---|---|---|
| 2851550 | 6/1979 | Fed. Rep. of Germany | 446/443 |
| 2817441 | 10/1979 | Fed. Rep. of Germany | 446/460 |
| 2030880 | 4/1980 | United Kingdom | 446/443 |
| 2037598 | 7/1980 | United Kingdom | 446/443 |

*Primary Examiner*—Danton D. DeMille
*Attorney, Agent, or Firm*—Ladas & Parry

[57] ABSTRACT

A steering device for an automotive vehicle toy comprises a motor to be driven by a remote control operation, a steering mechanism having a return spring for biasing steering wheels into a neutral position, and a clutch for transmitting a driving force of the electric motor to the steering mechanism against the return spring. The clutch includes a holding disc, clutch elements engageable with the holding disc such that the clutch elements can be moved in a radial direction of the holding disc by a centrifugal force, and an outer cylindrical member concentrically accommodating the holding disc and the clutch elements in it, and firmly secured to the mechanical reduction gear. A plurality of engaging groove portions are formed in the holding disc at equal spaces through a partition wall. An engaging element engageable with the engaging groove portions is formed on an inner side of that outer peripheral portion of each clutch element which is brought into pressure contact with an inner peripheral surface of the outer cylindrical member. Each engaging element has a cut portion engageable with the partition wall. The clutch elements are engaged with either the engaging grooves or the partition wall such that the clutch elements are slidable in the radial direction.

1 Claim, 3 Drawing Sheets

STEERING DEVICE FOR AUTOMOTIVE VEHICLE TOY

BACKGROUND OF THE INVENTION

This invention relates to a steering device, in which a clutch of a remote control vehicle toy, such as a radio-controlled vehicle toy, is improved.

Heretofore, there is known a steering device of an automotive vehicle toy of the type mentioned above as discussed in an early laid-open publication of a Japanese Utility Model Application No. 55269/1988. This steering device has an operating mechanism comprising a chassis for supporting at front end portion thereof a pair of steering wheels such that the steering wheels can make a change of direction, a pair of tie rods connected at one ends thereof to the pair of steering wheels, respectively, and an operating member horizontally pivotably supported on the chassis and connected to the other ends of the tie rods. The steering member is connected, through both a clutch and a mechanical reduction gear, to a small-sized steering electric motor which is also mounted on the chassis. The steering member is biased by a return spring into a neutral position.

As for the clutch, a holding disc is firmly secured to a rotary shaft of the small-sized steering electric motor, a plurality of arcuate clutch elements are engaged with the outer periphery of the holding disc, and an outer cylindrical member, the inner peripheral surface of which is pressure contacted by the clutch elements, is firmly secured to a gear on the driving side in the mechanical reduction gear.

The conventional steering device thus constructed is operated as follows. That is, for example, a hand-carry type transmitter is operated to transmit instructions to a receiver contained in the automotive vehicle toy in order to drive a small-sized driving electric motor by utilizing dry batteries loaded in the vehicle toy as a power source. In accordance with the instructions from the transmitter, the driving electric motor causes the automotive vehicle toy to run forwardly and backwardly. The small-sized steering electric motor is also rotated normally and reversely in accordance with the instructions from the transmitter. Upon rotation of the small-sized steering electric motor, a driving force thereof is transmitted to the steering member in the steering mechanism through the clutch and mechanical reduction gear in order to cause the steering member to be pivoted against the return spring, so that the steering wheels would be pivoted through the tie rods, etc., thereby making a change of direction rightwardly and leftwardly. When the transmitter is brought back to the neutral position, the supply of an electric current to the small-sized steering electric motor is cut, so that the clutch would be turned off. In this condition, the steering member is brought back to the neutral position by the return spring. As a result, the steering wheels are brought into a straight-forward condition.

During the driving of the small-sized operating electric motor, the clutch elements are moved towards the outer periphery side of the holding disc by a centrifugal force caused by rotation of the rotary shaft, so that the clutch elements would be brought into pressure contact with the inner peripheral surface of the outer cylindrical member. As a result, the clutch is turned on. On the contrary, when the supply of the electric current to the small-sized operating electric motor is cut, the pressure contacting relation between the clutch elements and the inner peripheral surface of the outer cylindrical element is removed. As a result, the clutch is turned off. In this condition, the steering wheels are brought back to the neutral position by the spring force of the return spring.

However, the above-mentioned steering device for an automotive vehicle toy has the following problems. When the spring force of the return spring and output of the small-sized operating electric motor are changed by some reasons (for example, change in size of the steering wheels), the clutch is also required to be replaced by another one having a different size. This means that the clutch must also be changed in accordance with various kinds of automotive vehicle toys. Therefore, production efficiency is bad.

The above prior art device has additional problems in that when the clutch is repeatedly turned on and turned off, the temperature within the outer cylindrical member becomes high because of heat caused by friction between the outer peripheral portions of the clutch elements and the inner peripheral surface of the outer cylindrical member. Therefore, the outer cylindrical member and clutch elements must be formed of a heat-proof material so that they can stand a high temperature.

SUMMARY OF THE INVENTION

It is, therefore, an object of the present invention to provide, in order to solve the above problems, a steering device for an automotive vehicle toy, in which one kind of clutch can be easily used for steering devices for various kinds of automotive vehicle toys, which have return springs of different spring forces and small-sized steering electric motors of different outputs.

Another object of the present invention is to provide a steering device for an automotive vehicle toy, in which the temperature within an outer cylindrical member can be maintained comparatively low.

To achieve the first-mentioned object, according to the present invention, there is essentially provided a steering device for an automotive vehicle toy comprising a small-sized steering electric motor to be driven normally and reversely by a remote control operation, a steering mechanism having a return spring for biasing steering wheels into a neutral position, and a clutch for transmitting, through a mechanical reduction gear, a driving force of the electric motor to the steering mechanism against the return spring, the clutch including a holding disc firmly secured to a rotary shaft of the electric motor, a plurality of clutch elements engageable with the holding disc such that the clutch elements can be moved in a radial direction of the holding disc by a centrifugal force, and an outer cylindrical member concentrically accommodating therein the holding disc and the clutch elements, and firmly secured to a driving side gear in the mechanical reduction gear, a plurality of engaging groove portions being formed in a peripheral surface of the holding disc at equal spaces through a partition wall, an engaging element engageable with the engaging groove portions being formed on an inner side of that outer peripheral portion of each of the clutch elements brought into pressure contact with an inner peripheral surface of the outer cylindrical member, each of the engaging elements being provided with a cut portion engageable with the partition wall, the clutch elements being engaged with either the engaging grooves or the partition wall such that the clutch elements are slidable in the radial direction. Each of the groove portions may be formed in a sector shape in section.

In order to achieve the second-mentioned object, the outer cylindrical member of the above-mentioned steering device for an automotive vehicle toy of the present invention is provided with an end wall integral with the driving side gear, and the end wall is provided with heat releasing holes formed therein and intercommunicating inside and outside of the outer cylindrical member.

By virtue of the above construction of a steering device for an automotive vehicle toy which is provided for the purpose of achieving the first-mentioned object, in the case where the force of the return spring and the output of the small-sized steering electric motor are large, the contacting areas between the holding disc and the clutch elements can be increased by bringing the engaging portions of the clutch elements into engagement with the sector-shaped groove portions formed in the holding disc, and therefore a large force can be surely transmitted to the outer cylindrical member from the holding disc through the clutch elements when the clutch is in the ON-state.

On the other hand, in the case where the force of the return spring and the output of the small-sized steering electric motor are small, the contacting areas between the holding disc and the clutch elements can be reduced by bringing the cut portions of the clutch elements into engagement with the partition wall of the holding disc, and therefore the clutch elements can be moved against the spring force of the return spring even by an electric motor having a small output, thus enabling to reduce the consumption of electric power of the electric motor.

Accordingly, simply by changing those portions of the clutch elements engaging with the holding disc, one kind of a one-way clutch can be easily used to various kinds of automotive vehicle toys which are provided with return springs having different spring forces, and small-sized steering electric motors having different outputs. Therefore, productivity of the clutch can be enhanced.

Likewise, by virtue of the construction of a steering device for an automotive vehicle toy for the purpose of achieving the second-mentioned object, heat generated by friction between the outer peripheral portions of the clutch elements and the inner peripheral surface of the outer cylindrical member can be released through the heat releasing holes, and therefore the temperature within the outer cylindrical member does not become high even if the clutch is repeatedly turned on and turned off. As a result, both the outer cylindrical member and clutch can be formed of an inexpensive synthetic resin material having low heat-proof properties. Moreover, owing to the provision of the heat releasing holes, the outer cylindrical member can be made light in weight, and can be pivoted with a small force.

DETAILED DESCRIPTION OF THE EMBODIMENTS

One preferred embodiment of the present invention will now be described with reference to FIGS. 1 through 7.

Figure 1:
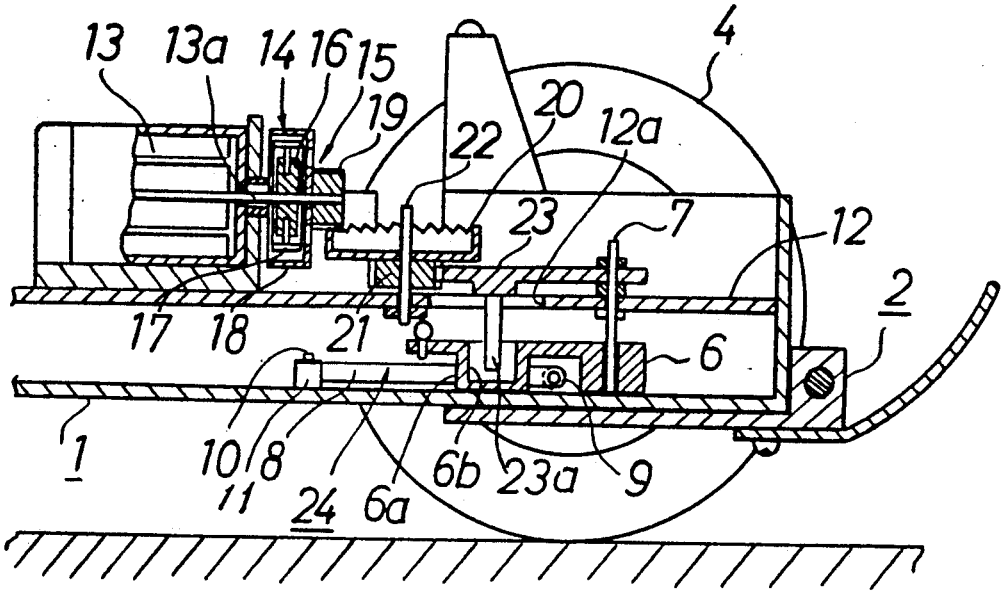
FIG. 1 is a cross sectional side view showing a steering device for an automotive vehicle toy according to one embodiment of the present invention.
Figure 2:
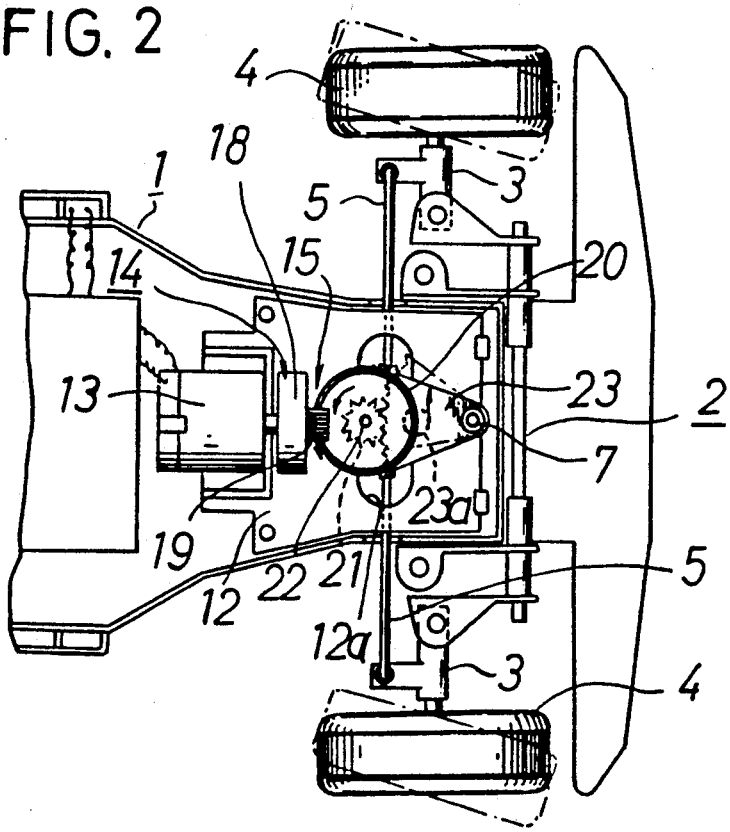
FIG. 2 is a plan view of the steering device of FIG. 1.
Figure 3:
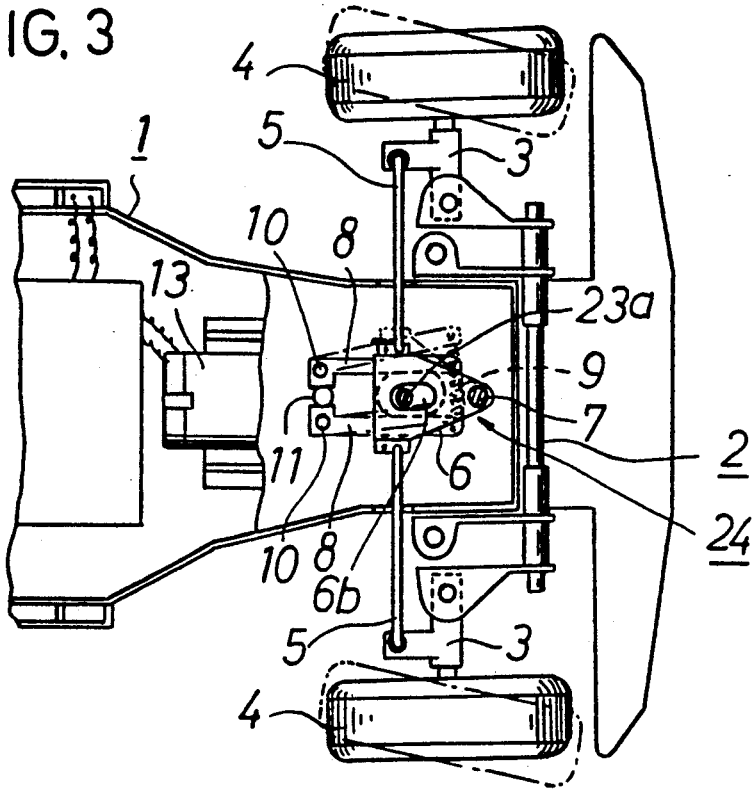
FIG. 3 is a plan view similar to FIG. 2, but with a front portion of an electric motor supporting plate cut away.

In FIGS. 1, 2, and 3, the numeral 1 denotes a chassis of a radio control automotive vehicle toy. A suspension member 2 is suspended across a front end portion of the chassis 1. A pair of brackets 3 are mounted respectively on both ends of the suspension member 2, and pivotable about vertical shafts, respectively. A pair of front steering wheels 4 are mounted on the brackets 3, respectively, such that the front steering wheels 4 can be pivoted about a horizontal axle. Mounted on a rear portion of the chassis 1 are a small-sized electric motor to be driven normally and reversely, and a pair of rear wheels, i.e., driving wheels which are driven by this electric motor, not shown. Dry batteries, as a power source for driving the driving electric motor, and a receiver, are mounted on the chassis 1.

Connected respectively to the brackets 3 are the outer end portions of the tie rods 5, inner end portions of which are, in turn, connected to the steering member 6. The steering member 6 is pivotably supported at a front end portion thereof by a vertical shaft 7 which is firmly secured to the center of the front end portion of the chassis 1. A projection 6*a* having a pair of ribs is formed on a lower surface of a rear end portion of the chassis 1.

A pair of spring supporting rods 8 are disposed below the steering member 6, and a coil return spring 9 is disposed between front end portions of the spring supporting rods 8. Inner surfaces of intermediate portions of the spring supporting rods 8 are abutted against the ribs of the return projection 6*a*, respectively, and rear end portions of the spring supporting rods 8 are pivotably supported on the chassis 1 through short vertical shafts 10. A stopper 11 is firmly secured to the chassis 1, and inner sides or faces of the supporting rods 8 are supported by the stopper 11 between an abutment portion of the operating projection 6*a* and pivotal portions of the vertical shafts 10. The brackets 3, tie rods 5, steering member 6, vertical shaft 7, spring supporting rods 8, return spring 9, short vertical shafts 10, and stopper 11 all together constitute a steering mechanism 24.

An electric motor supporting plate 12 is removably secured to an upper part of the front portion of the chassis 1. A small-sized steering electric motor 13, which is driven normally and reversely by the dry batteries (not shown) as a power source, is fixedly supported on the supporting plate 12. The arrangement being such that a driving force is transmitted to the steering member 6 from the electric motor 13 through a mechanical reduction gear 15 having a clutch 14 built therein.

Figure 4:
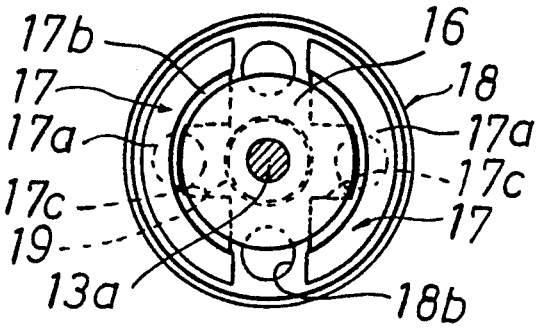
FIG. 4 is an enlarged front view of a clutch.
Figure 5:
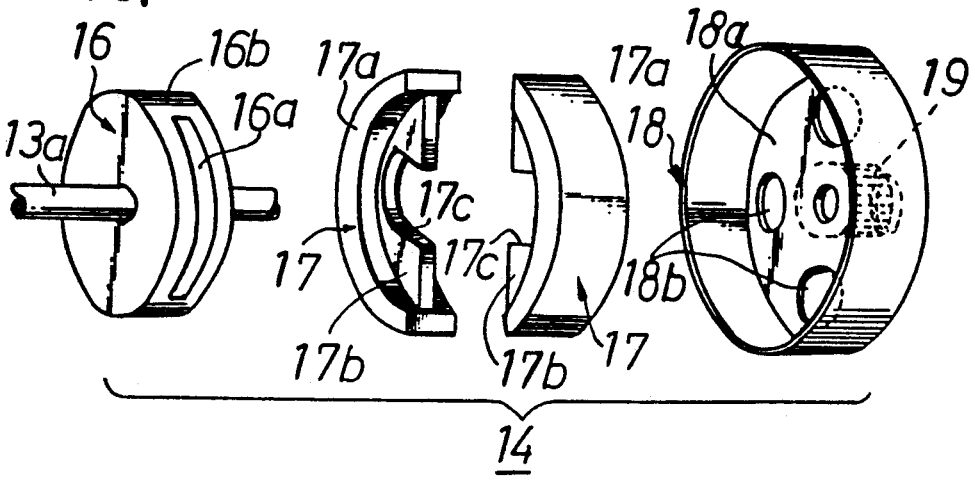
FIG. 5 is an enlarged exploded perspective view of the clutch.
Figure 6:
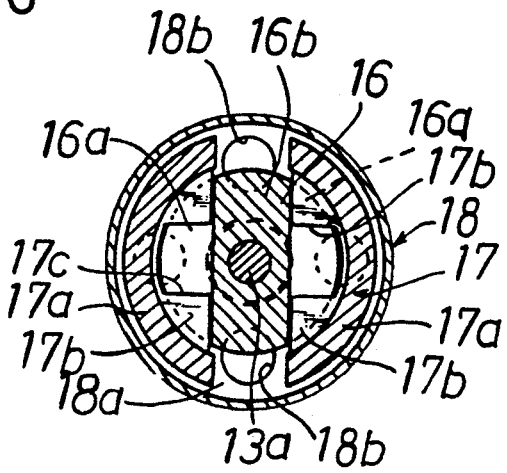
FIG. 6 is a cross sectional front view showing one example of an engaging relation between a holding disc of the clutch and clutch elements.

As shown in FIGS. 4, 5, and 6, the clutch or clutch assembly 14 comprises a holding disc 16 fixedly attached to a rotary shaft 13*a* of the small-sized steering electric motor 13, a pair of clutch elements 17 removably engaged with the holding disc 16, and an outer cylindrical member 18 with which the clutch elements 17 are covered.

More specifically, the holding disc 16 is provided at an axially central portion thereof with groove portions 16*a* having a generally identical sector-like configuration formed in opposite relation at equal spaces through a partition wall 16*b* and opened up at two places on the outer peripheral surface in the circumferential direction thereof. Each of the clutch elements 17 is provided with an engaging portion 17*b* integrally formed on an inner side of an arcuate outer peripheral portion 17*a* thereof and removably engaged in corresponding one of the sector-shaped groove portions 16*a*. Each of the engaging portions 17*b* is provided at a circumferentially central portion thereof with a cut portion 17*c* removably engaged with the partition wall 16*b*. A driving side gear 19 having a small diameter is disposed in such a manner as to be coaxially integral with an end wall 18*a* of the outer cylindrical member 18, and the number, four, of heat releasing holes 18*b* intercommunicating inside and outside of the outer cylindrical member 18 are also formed in the end wall 18*a*. The holding disc 16, clutch elements 17, and the outer cylindrical member 18 are formed of a synthetic resin molding, respectively.

Figure 7:
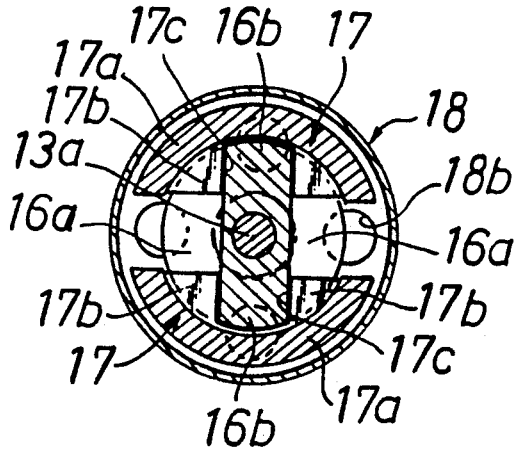
FIG. 7 is a cross sectional front view showing another example of the engaging relation between the holding disc and the clutch elements.

In the case where the spring force of the return spring 9 and the output of the small-sized steering electric motor 13 are large, or in other similar cases, the engaging portions 17*b* of the clutch elements 17 are brought into engagement with the sector-shaped groove portions 16*a* in the holding disc 16, such that the engaging portions 17*b* would be slidable in the radial direction, as shown in FIGS. 4 and 6. In contrast, in the case where the spring force of the return spring 9 and the output of the electric motor 13 are small, or in other similar cases, the cut portions 17*c* formed in the engaging portions 17*b* of the clutch elements 17 are brought into engagement with the partition wall 16*b* on the holding disc 16, such that the cut portions 17*c* would be slidable in the radial direction, as shown in FIG. 7. Owing to the foregoing arrangement, the holding disc 16 and clutch elements 17 of the same sizes can be used for electric motors 13 of the kinds having different outputs, respectively. By concentrically covering the holding disc 16 and clutch elements 17 with the outer cylindrical member 18 and restraining the axial movement of the outer cylindrical member 18 by suitable means, and then relatively pivotably attaching or fitting them to the rotary shaft 13*a*, the clutch 14 is constituted.

The driving side gear 19 of a small diameter is meshed with a crown gear 20 having a large diameter. Integrally formed on a lower surface of this gear 20 is an idle pinion gear 21, which is pivotably supported by an upper vertical shaft 22 firmly secured to the supporting plate 12. The idle pinion gear 21 is meshed with a sector gear 23 which is, in turn, pivotably mounted on an upper end portion of the vertical shaft 7 on which the steering member 6 is mounted. In this condition, the idle pinion gear 21 and sector gear 23 are supported on the supporting plate 12.

An operating rod 23*a* extending downward from the sector gear 23 is loosely fitted into a hole 12*a* formed in the supporting plate 12 and slidably engaged with an engaging slot 6*b* elongate in the forward and backward direction and opened up at an upper surface of the operating member 6 for sliding in the forward and backward direction. Although not shown, a cover member for pivotably supporting upper end portions of the vertical shafts 7 and 22 and covering the electric motor 13, clutch 14, and mechanical reduction gear 15, is removably secured on the supporting plate 12. Ribs supporting the sector gear 23 are formed in an arcuate pattern (in a plan view) on the supporting plate 12.

Next, operation of a steering device for an automotive vehicle toy thus constructed will be described.

A hand-carry type transmitter is operated to transmit "run" instructions to a receiver on the chassis in order to drive a small-sized driving electric motor. In accordance with the normal/reverse rotation of this electric motor, the driving wheels are driven. As a result, the automotive vehicle toy runs forwardly/backwardly.

In this running condition of the automotive vehicle toy, when an operation for changing a direction is not made with respect to the transmitter, the steering member 6 keeps its neutral position, and therefore the automotive vehicle toy moves forwardly. In contrast, when an operation for changing a direction either rightward or leftward is made with respect to the transmitter in the above running condition of the automotive vehicle toy, so that change-direction instructions would be transmitted to the receiver, the small-sized steering electric motor 13 is driven normally or reversely. The clutch elements 17 are urged outwardly in the radial direction of the holding disc 16 by a centrifugal force caused by rotation of the rotary shaft 13*a*, and outer surfaces of the clutch elements 17 are pressure contacted with the inner peripheral surface of the outer cylindrical member 18. As a result, the clutch elements 17 and the outer cylindrical member 18 are brought into friction engagement with each other, thereby turning on the clutch 14.

As a consequence, the driving force of the electric motor 13 is transmitted to the rotary shaft 13*a*, holding disc 16, clutch elements 17, outer cylindrical member 18, driving side gear 19, crown gear 20, idle gear 21, and sector gear 23 in this order, and the steering member 6 is pivoted, as shown by the chain lines of FIG. 3, about the vertical shaft 7 by the operating rod 23*a* of the sector gear 23 against the spring force of the return spring 9. In accordance with the pivotal movement of the steering member 6, the steering wheels 4 are pivoted leftwardly or rightwardly through the tie rods 5 and brackets 3. As a result, the automotive vehicle toy makes a change of direction.

When the operation for making a change of direction is ceased with respect to the transmitter, the instructions to the receiver are canceled, and the supply of electric current to the electric motor 13 is cut. As a result, the rotary shaft 13*a* of the electric motor 13 is rotated by an inertia force and decelerated. As a result, the centrifugal force acted on the clutch elements 17 is reduced, and therefore the pressure contacting force of the clutch elements 17 with respect to the outer cylindrical member 18 is reduced, too. As a result, the clutch 14 is turned off. The electric motor 13 is stopped soon after deceleration. Because the steering member 6 is urged into the neutral position by one of the spring supporting rods 8 caused by the spring force of the return spring 9, the steering member 6 is brought back into the neutral position, and the steering wheels 4 are returned into the straight-forward conditions through the tie rod 5 and brackets 3.

At this time, the operating member 6 causes those elements of the mechanical reduction gear 15 in a range from the sector gear 23 to the output gear 19 to be pivoted with the spring force of the return spring 9. However, because the clutch 14 is in the OFF-state, the pivotal force is not transmitted to the rotary shaft 13*a* nor a rotor of the electric motor 13. Therefore, the steering wheels 4 can be brought back into the straightforward condition even with a comparatively small spring force of the return spring 9.

At the time when the clutch 14 is turned on or turned off, the engaging portions 17*b* are in engagement with the sector-shaped groove portions 16*a* of the holding disc 16, and the cut portions formed in the engaging portions 17*b* are in engagement with the partition wall 16*b* of the holding disc 16, and the clutch elements 17 are moved in the radial direction while sliding on the holding disc 16. Therefore, the clutch elements 17 are not escaped from the holding disc 16. Furthermore, because the pressure contacting plane between each of the clutch elements 17 and the outer cylindrical member 18 is arcuate, and the clutch elements 17 and outer cylindrical member 18 are concentrically arranged, and the holding disc 16, clutch elements 17 and outer cylindrical member 18 are all formed of a synthetic material, noises are not generated when the clutch 14 is turned on or turned off.

In the case where the engaging portions 17*b* of the clutch elements 17, as shown in FIG. 6, are engaged in the sector-shaped groove portions 16*a* of the holding disc 16 of the clutch 14, the slide contacting areas between the holding disc 16 and the clutch elements 17 are large. Therefore, in the condition that the contact element 17 are in pressure contact with the outer cylindrical member 18, a large force can be surely transmitted to the outer cylindrical member 18 from the holding disc 16 through the clutch elements 17, and a reliable steering operation can be obtained even for an automotive vehicle toy having a large spring force return spring 9 and a large output small-sized steering electric motor 13.

In the case where the cut portions 17*c* formed in the engaging portions 17*b* of the clutch elements 17 are engaged with the partition wall 16*b* of the holding disc 16, the contacting areas between the holding disc 16 and the clutch elements 17 are small. Therefore, the clutch elements 17 can be moved against the spring force of the return spring 9 even by an electric motor 13 having a small output. As a result, consumption of electric power of the electric motor 13 can be reduced.

Thus, one kind of the clutch can be easily used for steering devices of different types (for example, two types) simply by changing those portions of the clutch elements 17 which are engaged with the holding disc 16 in accordance with amounts of outputs (i.e., a large output or a small output) of the electric motors, etc.

Furthermore, since the heat, which is to be generated by friction between the outer peripheral portions 17*a* of the clutch elements 17 and the inner peripheral surface of the outer cylindrical member 18, is released outside the outer cylindrical member 18 through the heat releasing holes 18*b* formed in the end wall 18*a* of the outer cylindrical member 18, the internal temperature of the outer cylindrical member 18 does not become high even if the clutch 14 is busily turned on and turned off in a short time interval. In addition, owing to the provision of the heat releasing holes 18*b*, the outer cylindrical member 18 can be made light in weight.

In the above embodiment, the number of the clutch elements was two. According to the present invention, however, the number of the clutch elements may be three or more. Similarly, the steering mechanism is not limited to the above embodiment, and various modifications can be made.

As described in the foregoing, a steering device for an automotive vehicle toy according to the present invention comprises a small-sized steering electric motor to be driven normally and reversely by a remote control operation, a steering mechanism having a return spring for biasing steering wheels into a neutral position, and a clutch for transmitting, through a mechanical reduction gear, a driving force of the electric motor to the steering mechanism against the return spring, the clutch including a holding disc firmly secured to a rotary shaft of the electric motor, a plurality of clutch elements engageable with the holding disc such that the clutch elements can be moved in a radial direction of the holding disc by a centrifugal force, and an outer cylindrical member concentrically accommodating therein the holding disc and the clutch elements, and firmly secured to a driving side gear in the mechanical reduction gear, a plurality of engaging groove portions being formed in a peripheral surface of the holding disc at equal spaces through a partition wall, an engaging element engageable with the engaging groove portions being formed on an inner side of that outer peripheral portion of each of the clutch elements brought into pressure contact with an inner peripheral surface of the outer cylindrical member, each of the engaging elements being provided with a cut portion engageable with the partition wall, the clutch elements being engaged with either the engaging grooves or the partition wall such that the clutch elements are slidable in the radial direction. Accordingly, the following effects can be obtained.

That is, in the case where the spring force of the return spring and the output of the small-sized steering electric motor are large, the contacting areas between the holding disc and the clutch elements can be increased by bringing the engaging portions of the clutch elements into engagement with the sector-shaped groove portions of the holding disc., and therefore a large force can be surely transmitted to the outer cylindrical member from the holding disc through the clutch elements when the clutch is in the ON-state (see FIG. 6).

On the other hand, in the case where the spring force of the return spring and the output of the small-sized steering electric motor are small, the contacting areas between the holding disc and the clutch elements can be reduced by bringing the cut portions formed in the clutch elements into engagement with the partition wall of the holding disc, and therefore the clutch elements can be moved against the spring force of the return spring even by an electric motor having a small output, thus enabling to reduce consumption of electric power of the electric motor.

Accordingly, simply by changing those portions of the clutch elements engaging with the holding disc in accordance with the spring forces of the return springs and the outputs of the small-sized steering motors, one kind of a one-way clutch can be easily used for steering devices of different types. Therefore, productivity of the clutch can be enhanced.

Furthermore, according to a steering device for an automotive vehicle toy of the present invention, the outer cylindrical member may be provided with an end wall integral with the driving side gear, and the end wall may be provided with heat releasing holes formed therein and intercommunicating inside and outside of the outer cylindrical member. Accordingly, the following effects can be obtained.

That is, the heat generated by friction between the outer peripheral portions of the clutch elements and the inner peripheral surface of the outer cylindrical member can be released through the heat releasing holes, and therefore the temperature within the outer cylindrical member does not become high even if the clutch is repeatedly turned on and turned off. As a result, both the outer cylindrical member and clutch can be formed of an inexpensive synthetic resin material having a low heat-proof properties. Moreover, owing to the provision of the heat releasing holes, the outer cylindrical member can be made light in weight, and can be pivoted with a small force.

What is claimed is:

1. A steering device for an automotive vehicle toy comprising a small-sized steering electric motor to be driven forwardly and reversely by a remote control operation, a steering mechanism having a return spring for biasing steering wheels into a neutral position, and a clutch for transmitting, through a mechanical reduction gearing, the driving force of said electric motor to said steering mechanism against the bias of said return spring, said clutch comprising:

a holding disc firmly secured to a rotary shaft of said electric motor;

a plurality of clutch elements engageable with said holding disc such that said clutch elements can be moved in a radial direction of said holding disc by a centrifugal force; and an outer cylindrical member concentrically accommodating therein said holding disc and said clutch elements, and firmly secured to said mechanical reduction gearing, said outer cylindrical member having an inner peripheral surface, and each of said clutch elements having an outer peripheral surface engageable, by pressure contact, with said inner peripheral surface of said outer cylindrical member; and wherein:

a plurality of equally spaced peripheral grooves are formed in a peripheral surface of said holding disc, thereby defining an equal plurality of peripheral surface sectors between said peripheral grooves;

each said clutch element includes an engaging element engageable in one of said grooves, each of said engaging elements being provided with a cutout portion sized to receive therein one of said peripheral surface sectors, said clutch elements being selectively arranged relative to said holding disc into one of two alternative configurations, a first configuration wherein said engaging elements are positioned in said grooves, and a second configuration wherein said peripheral surface sectors are received in said cutout portions; and said clutch elements are slidable in the radial direction in both said configurations.

* * * * *